US005762057A

United States Patent [19]

Laabs et al.

[11] Patent Number: 5,762,057

[45] Date of Patent: Jun. 9, 1998

[54] LIGHT GAS GUN WITH REDUCED TIMING JITTER

[75] Inventors: Gary W. Laabs; David J. Funk; Blaine W. Asay, all of Los Alamos, N. Mex.

[73] Assignee: The United States of America as represented by the United States Department of Energy, Washington, D.C.

[21] Appl. No.: 774,502

[22] Filed: Dec. 30, 1996

[51] Int. Cl.[6] ..... F41B 11/00

[52] U.S. Cl. ..... 124/56

[58] Field of Search ..... 124/56, 57, 71

[56] References Cited

U.S. PATENT DOCUMENTS

| | | | |
|---|---|---|---|
| 3,597,969 | 8/1971 | Curchack | 73/167 |
| 4,094,294 | 6/1978 | Speer | 124/56 |
| 4,747,350 | 5/1988 | Szecket | 102/306 |
| 5,303,633 | 4/1994 | Guthrie et al. | 89/8 |
| 5,353,779 | 10/1994 | Lyon | 124/57 |
| 5,365,913 | 11/1994 | Walton | 124/75 |

FOREIGN PATENT DOCUMENTS

| | | | |
|---|---|---|---|
| 1021411 | 2/1953 | France | 124/56 |
| 2227114 | 12/1973 | Germany | 124/56 |
| 593821 | 5/1959 | Italy | 124/56 |
| 185315 | 10/1966 | U.S.S.R. | 124/56 |

OTHER PUBLICATIONS

Gary W. Laabs et al., "Novel Light Gas Gun With Minimal Timing Jitter," Rev. Sci. Instrum. 67 (1), Jan. 1996, describes the gas gun which is the subject of the present invention.

*Primary Examiner*—John A. Ricci

*Attorney, Agent, or Firm*—Samuel M. Freund; William A. Eklund; William R. Moser

[57] ABSTRACT

Gas gun with reduced timing jitter. A gas gun having a prepressurized projectile held in place with a glass rod in compression is described. The glass rod is destroyed with an explosive at a precise time which allows a restraining pin to be moved and free the projectile.

7 Claims, 3 Drawing Sheets

LIGHT GAS GUN WITH REDUCED TIMING JITTER

FIELD OF THE INVENTION

The present invention relates generally to gas guns and, more particularly, to gas guns having a precisely timed firing of a prepressurized projectile. This invention was made with government support under Contract No. W-7405-ENG-36 awarded by the U.S. Department of Energy to The Regents to the University of California. The government has certain rights in the invention.

BACKGROUND OF THE INVENTION

Dynamic shock experiments often require projectile impact to produce conditions of interest. Examples are studies of shock initiation of explosives, the equations of state of various materials, and wave interactions. Diagnostic devices used in such studies include asynchronous framing cameras, electronic cameras, pressure gauges, shock pins, and velocity interferometers. For these devices, when the projectile reaches a predetermined position, recording equipment such as transient digitizers, flash units, and laser pulses are triggered. Thus, the reference time is tied to the projectile location, once it has reached a steady velocity.

This timing arrangement is satisfactory if the diagnostic devices can be triggered at any time. For example, an asynchronous framing camera uses a rotating mirror and a continuous film track and therefore it is in a continuous ready state. All that is needed is a light flash of proper pulse length and intensity which can arrive at any time. Similarly, a transient digitizer is always ready to acquire data whenever the appropriate trigger is provided.

Some diagnostic devices are not always in the ready state; they are designed to generate the trigger at specific times when they are available to record data. For example, synchronous framing cameras use a rotating mirror, but have a film track that proceeds only part of the way around the circumference. These cameras send a synchronous pulse when the mirror is in a predetermined position, and recordable events in the experiment must be synchronized to this condition.

High pressure gas guns are commonly employed to accelerate projectiles for experiments which include impact studies and weapons uses. Conventional gas guns include a projectile which is located in the breech of the gun and a mechanism which triggers the release of a gas which impinges on the projectile and causes it to move out of the breech and down the barrel of the gun. The variable delay (0.5–10 ms) between gas release and the generation of sufficient force to move the projectile makes these gas guns high jitter devices, i.e., devices with low precision timing of the firing of a projectile. Due to this high jitter, gas guns have only been used with asynchronous diagnostics.

Several designs of gas guns are known. U.S. Pat. No. 4,747,350 for "Hollow Charge" which is issued to A. Szecket on May 31, 1988 describes a gun design which employs a disc to separate the barrel of the gas gun from a pressurized gas chamber. Upon reaching a critical pressure, the disc ruptures releasing the gas into the barrel to move the projectile. Similarly, U.S. Pat. No. 5,365,913 for "Rupture Disc Gas Launcher" issued to G. L. Walton on Nov. 22, 1994 describes a rupture disc placed between a compressed gas and a launcher tube in a gas launcher. The operator increases the pressure in the pressure chamber until it exceeds the rupture threshold of the disc, whereupon the disc ruptures and the gas escapes from the compressed gas chamber past the ruptured disc and pushes the projectile out of the launch tube.

U.S. Pat. No. 5,303,633 for "Shock Compression Jet Gun" issued to M. J. Guthrie et al. on Apr. 19, 1994 describes a chamber containing an explosive charge, a gas (or a substance that generates gas upon detonation of the explosive charge), and a barrier separating the charge from the gas. A diaphragm separates the chamber from one end of an expansion nozzle. The other end of the nozzle is attached to a coaxial tube containing a projectile. The projectile may have a band providing a seal with the tube. Upon detonation of the explosive charge, gas in the chamber pressurizes the chamber, ruptures the diaphragm, is accelerated as it moves through the expansion chamber, and moves the projectile.

U.S. Pat. No. 3,597,969 for "Dynamic Tester For Projectile Components" issued to H. D. Curchack on Aug. 10, 1971 describes an automated dynamic tester for projectile components. FIG. 1 of Curchack shows a grooved projectile housed within the midsection of a closed chamber called the acceleration gun. The aft region of the chamber is at atmospheric pressure while the forward region of the chamber is under vacuum. A pin inserted into the projectile groove prevents it from moving. When the pressure of the forward chamber exceeds a predetermined value, a valve withdraws the pin from the projectile groove to free the projectile. Since Curchack requires a vacuum, the projectile must pass through a diaphragm which enables the chamber to be evacuated. Curchack does not teach the use of high pressure to move a projectile, nor an open gun barrel. Curchack also does not teach pneumatic means for withdrawing the pin from the groove in the projectile.

Low jitter devices require precisely timed projectile firing; electrically actuated mechanical devices such as solenoids cannot be employed because they have unacceptable inherent variability in timing.

In view of the need for a more precisely timed gas gun, an object of the present invention is to provide a gas gun having low jitter.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the gas gun having low jitter hereof includes a barrel having an open end, a closed end, and a bore, a projectile having a circumferential recess and adapted to move within the bore of the barrel and provide a substantially gas tight seal therewith, a pin capable of being inserted into the recess of the projectile for restraining the projectile, means for applying gas pressure between the closed end of the barrel and the projectile, and a pneumatic means for rapidly removing the restraining pin from the recess of the projectile. Benefits of the present invention include the controlled release of a projectile.

BRIEF DESCRIPTION OF THE DRAWINGS

The accompanying drawings, which are incorporated in and form a part of the specification, illustrate embodiments of the present invention and, together with the description, serve to explain the principles of the invention.

In the Figures:

FIG. 1*a* shows a side view of the apparatus of the present invention showing the restraint of a projectile having a circumferential recess, while

FIG. 2*a* shows the means for restraining and disengaging the pin which holds the projectile in place, while

DETAILED DESCRIPTION OF THE INVENTION

Figure 1A:
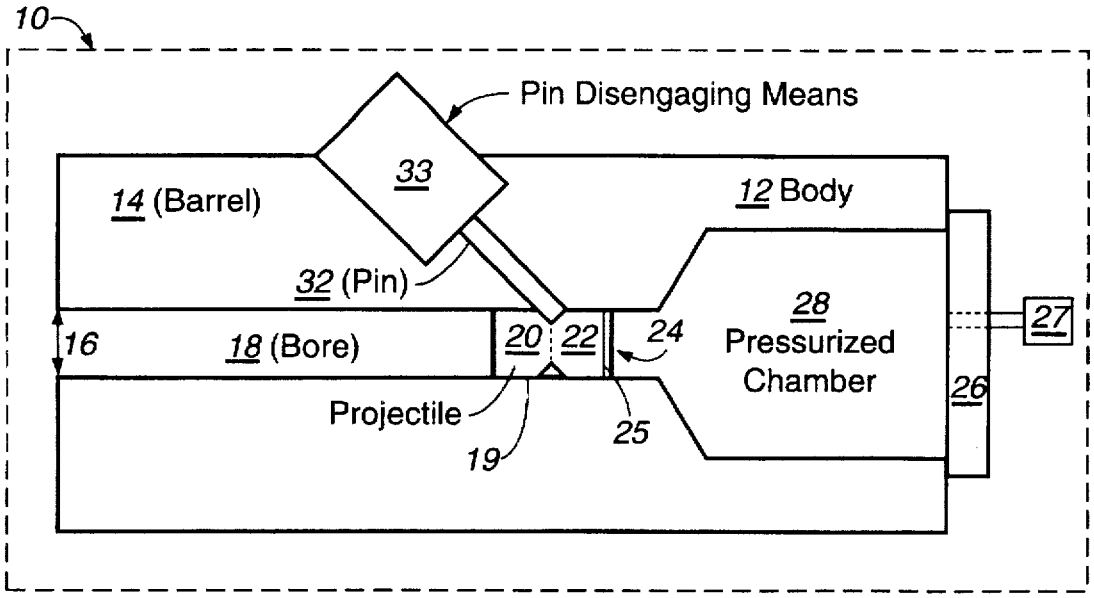

Briefly, the present invention includes a gas gun having a projectile restrained under static gas pressure by a pin. Turning now to the drawings, similar or identical structure is labeled by identical call-outs. FIG. 1*a* shows one embodiment of the invention. Gas gun 10 includes body 12 with barrel 14 having open end 16 and bore 18 into which is placed projectile 20 having a circumferential recess 22. Deformable disc 24 is attached to base 25 of projectile 20 and makes a substantially gas tight seal with bore 18. For some experiments, in place of deformable disc 24, an o-ring was placed in a groove cut into the projectile 20 to provide a seal with the barrel. Disc 24, inner wall of body 12, and flange 26 define chamber 28 which is pressurized by pressurization means 27. Projectile 20 is restrained from moving in response to gas pressure from chamber 28 by restraining pin 32 inserted into recess 22. Restraining pin 32 is held in place by restraining and disengaging means 33.

Figure 1B:
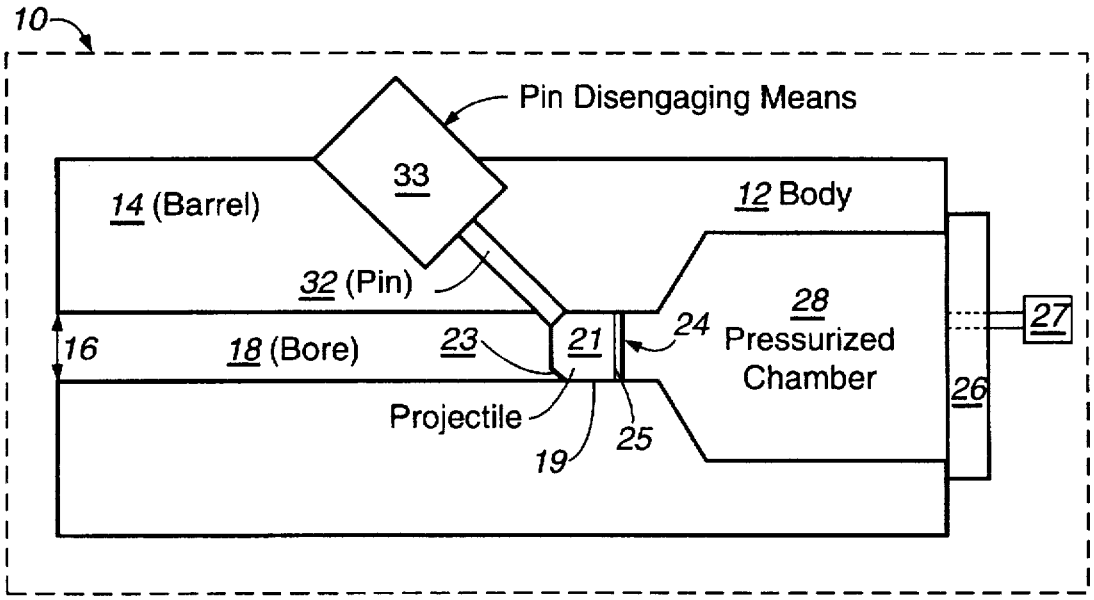
FIG. 1*b* shows the restraint of a projectile having a bevel in its forward end.

FIG. 1*b* illustrates another embodiment of the invention utilizing beveled projectile 21. Projectile 21 is restrained by pin 32 making contact with bevel 23.

Figure 2A:
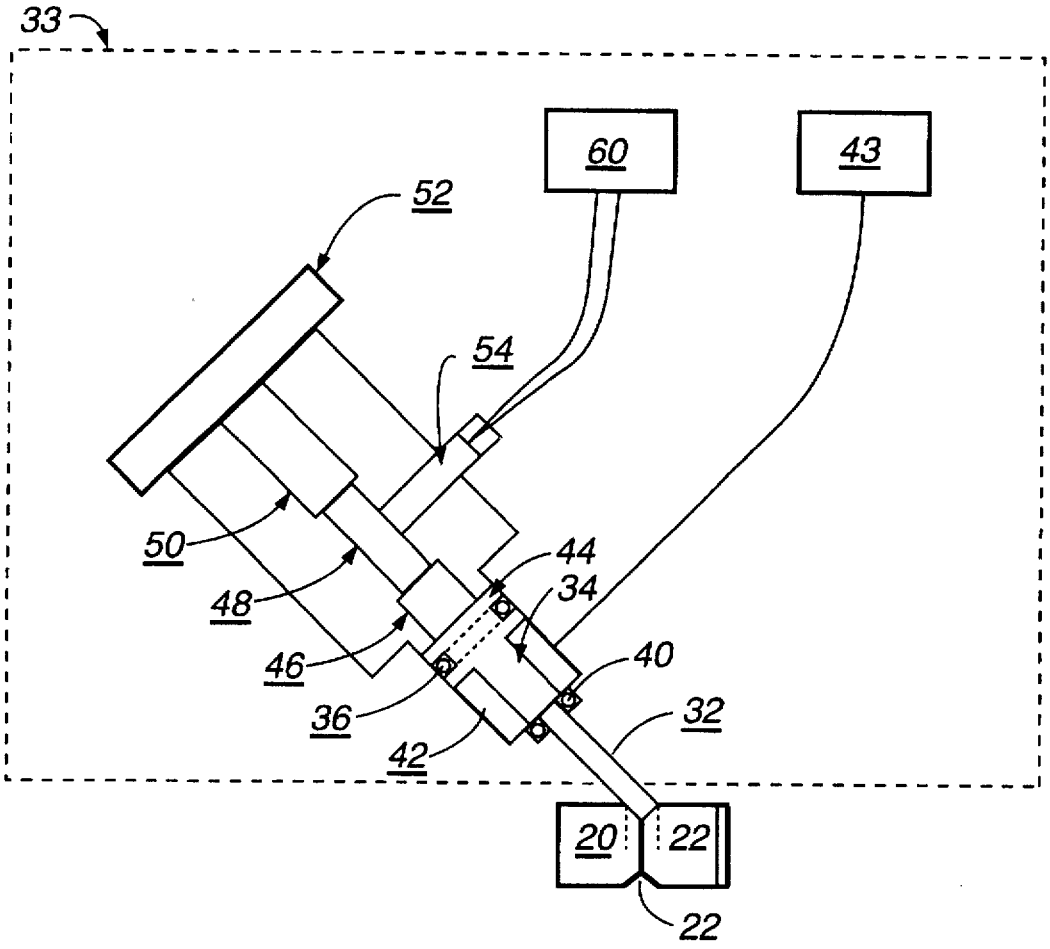

FIG. 2*a* shows details of pin restraining and disengaging means 33, which includes piston 34 housed within pressurized chamber 42 and making a substantially gas tight seal therewith by o-ring 36 and o-ring 40. Restraining pin 32 is attached to piston 34. Chamber 42 may be pressurized by pressurization means 43. Piston head 44 is connected to one end of breakable rod 48 by rod mount 46. The other end of breakable rod 48 is connected to flange 52 with rod mount 50. Flange 52 is connected to body 12 of FIG. 1*a* and 1*b*. Explosive 54 is near, or preferably in contact with breakable rod 48. Detonation means 60 is used to detonate explosive 54.

Figure 2B:
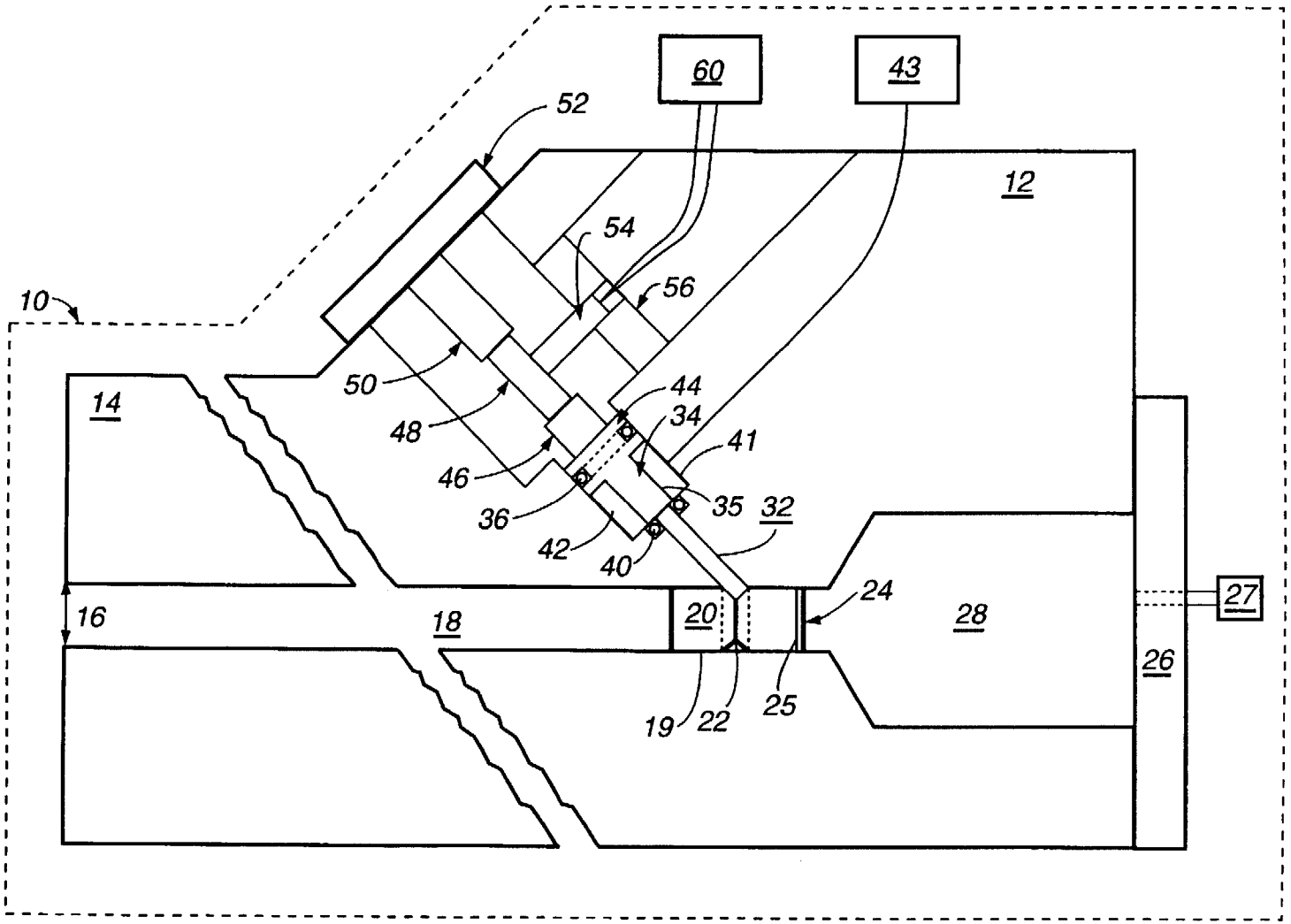
FIG. 2*b* shows a side view of the complete apparatus.

FIG. 2*b* illustrates the completed assembly of the embodiment illustrated in FIG. 1*a*, showing the relationship among restraining and disengaging means 33, restraining pin 32, and projectile 20. Projectile 20 is placed in breech 19 of gun 10. Deformable disc 24 was a plastic disc for the Example which follows. Restraining pin 32 is attached to piston 34. Piston wall 35, bore wall 41, o-ring 36 and o-ring 40 define chamber 42 which may be pressurized with pressurization means 43. When piston 34 is in place, o-ring 40 seals against wall 41 and restraining pin 32 fits into recess 22 of projectile 20. When flange 52 is attached to body 12, chamber 42 is pressurized by pressurization means 43, and chamber 28 is pressurized by means 27, pin 32 remains seated in recess 22 of projectile 20, thereby restraining it. Explosive 54 is mounted with detonator mount 56 such that explosive 54 is placed near or preferably in contact with breakable rod 48. Breakable rod 48 was a glass rod in the example below. The explosive 54 used in the Example was a Reynolds RP3 explosive detonator. At a desired time, detonation means 60 actuates explosive 54 which destroys rod 48, thereby allowing piston 34 to move in response to pressure within chamber 42 causing pin 32, which is attached to piston 34, to release projectile 20.

A major source of timing variability in conventional gas guns arises from delays in pressurization of the projectile. Electrically operated mechanical devices such as solenoids which have inherent timing variability in the millisecond to tens of milliseconds range are unacceptable for achieving low jitter. In the present invention, there is no delay due to initial buildup of pressure at base 25 for either projectile 20 or 21 because they are under constant high gas pressure.

Calculations using the equation below demonstrate that projectile 20 does not force pin 32 out of its way as it exits the breech 19. In contrast, pin 32 moves out of recess 22 of projectile 20 faster than projectile moves out of the breech 19. The ratio of the accelerations for the pin and the projectile is given by the following relationship:

$$\frac{a_{xpin}}{a_{xproj}} = \frac{A_{pin}m_{proj}}{A_{proj}m_{total}} \cos(\theta)$$

In the above equation, $a_{xpin}/a_{xproj}$ is the ratio of the x-components of the acceleration of pin 32 to projectile 20. The angle θ describes the angle that pin 32 makes with bore 18. The apparatus was designed with θ=45 degrees. Also for the apparatus designed, $A_{pin}/A_{proj}$, the ratio of pin surface area to projectile surface area, is 1.14. The ratio of the projectile mass to the combined mass of pin 32, piston 34, o-ring 36, and mount 46 (which must all move as pin 32 exits recess 22 of projectile 20), $m_{proj}/m_{comb}$, is 2.21. Substituting the values for the above ratios and angle and further assuming no significant contribution from friction, the ratio $a_{xpin}/a_{xproj}$ is 1.78; pin 32 acceleration is 1.78 times greater than projectile 20 acceleration. Therefore, when glass rod 48 breaks, pin 32 is not pushed out of recess 22 by projectile 20. The faster initial pin movement reduces potential delay caused by projectile 20 having to force the pin 32 out of the way as it exits the breech. Therefore, initial pressurization of the chamber 42 is essential in reducing the jitter of the invention.

EXAMPLE

The gas gun was designed to impart a velocity of 100–200 m/s to a projectile. The steel body of the gun was 54 cm long with a main bore diameter of 0.953 cm, and a gas chamber volume behind the projectile base of 50 $cm^3$. Substantially larger velocities may be obtained by lengthening the gun barrel. Larger gas chambers may be employed to reduce operating pressures, however high chamber pressures are essential to achieve low jitter. The cylindrical projectile used was made of brass and had a circumferential recess as shown in FIG. 1*a*. It weighed 10 g and had a diameter 0.025 mm less than the diameter of the bore to reduce static and sliding friction. The gun was pressure rated at 8.3 MPa (megapascals).

The results of eleven experiments conducted with four different starting gas pressures using helium gas are given in the Table. The projectile location was determined with an argon ion laser. The laser beam was first split into two beams that intersected the projectile flight path at chosen positions. The beams were then recombined and imaged onto a silicon photodiode. Four separate times were recorded corresponding to the projectile face intersecting each beam ($t_1$ and $t_3$) and the exit of the projectile from each beam ($t_2$ and $t_4$). Differences between times $t_1$ and $t_3$ and between times $t_2$ and $t_4$ were averaged, and these times were then used to calculate the velocity for that experiment. The average projectile velocities for experiments conducted with the same initial gas pressure are shown.

TABLE

| # Expts | Initial Pressure (MPa) | Barrel Transit Time (ms) | Exit Velocity (m/s) |
|---|---|---|---|
| 3 | 6.895 | 5.286 | 181.7 |
| 4 | 4.137 | 7.751 | 139.2 |
| 2 | 2.758 | 9.745 | 114.2 |
| 2 | 1.379 | 15.44 | 79.4 |

The barrel transit time is the time required for the projectile to travel through the main bore starting from rest. The barrel transit time ranges were very narrow, indicating a low jitter apparatus. At 6.895 MPa, the largest transit time difference, i.e. the jitter, for the 3 experiments was 41.2 μs, and for the 4 experiments at 4.137 MPa it was 58 μs. Thus, the jitter of the present invention is much smaller than that of typical gas guns, which have jitter of 0.5–10 ms.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A gas gun for firing a projectile, comprising:

a. a body having a barrel with an open end, a closed end, and a bore adapted to receive the projectile, said projectile having a circumferential recess and adapted to move within the bore of said barrel and provide a gastight seal therewith, b. a pin capable of being inserted into the recess of said projectile for restraining said projectile, c. means for applying gas pressure between the closed end of said barrel and said projectile, and d. pneumatic means for rapidly removing said restraining pin from the recess in said projectile.

2. The gas gun as described in claim 1, wherein said pneumatic means for removing said restraining pin includes a piston attached to said restraining pin, said piston being housed and slidable within a substantially gastight chamber capable of being pressurized.

3. The gas gun as described in claim 2, wherein said pneumatic means for removing said restraining pin further comprises:

a. a breakable rod, b. means for connecting one end of said rod to said piston, c. a flange connected to said gun body, d. means for connecting said flange to the other end of said rod, e. an explosive near or in contact with said breakable rod, and f. means for detonating said explosive.

4. The gas gun as described in claim 1, wherein said projectile is under gas pressure while restrained by said restraining pin prior to pneumatic release of said restraining pin which frees said projectile.

5. The gas gun as described in claim 1, wherein said body is a steel body.

6. The gas gun as described in claim 1, wherein said projectile is a brass projectile.

7. A gas gun for firing a projectile, comprising:

a. a body having a barrel with an open end, a closed end, and a bore adapted to receive the projectile, said projectile having a bevel facing the open end of the barrel and adapted to move within the bore of said barrel and provide a gastight seal therewith, b. a pin capable of restraining said projectile by engaging the bevel of said projectile, c. means for applying gas pressure between the closed end of said barrel and said projectile, and d. means for rapidly removing said restraining pin.

* * * * *